United States Patent [19]

Scholtz

[11] Patent Number: 4,564,538

[45] Date of Patent: Jan. 14, 1986

[54] FIREPLACE FAN

[76] Inventor: Martin P. Scholtz, 22 W. 25th St., Baltimore, Md. 21218

[21] Appl. No.: 640,445

[22] Filed: Aug. 13, 1984

[51] Int. Cl.[4] ..... A45B 27/00

[52] U.S. Cl. ..... 428/12; 156/204; 416/70 A; 416/73; 428/181

[58] Field of Search ..... D3/1, 2, 3, 4; 428/12, 428/181; 416/70 A, 73; 156/204

[56] References Cited

U.S. PATENT DOCUMENTS

| | | | |
|---|---|---|---|
| 278,410 | 5/1883 | DeQuillfeldt | 428/181 X |
| 300,930 | 6/1884 | White | 428/12 X |
| 966,190 | 8/1910 | Funk | 416/70 A |
| 1,273,384 | 7/1918 | Lesem | 416/70 A |
| 2,712,513 | 7/1955 | Breslow et al. | 428/181 X |
| 4,321,291 | 3/1982 | Brownell | 428/181 X |
| 4,352,630 | 10/1982 | Wallo | 416/70 A |

*Primary Examiner*—Henry F. Epstein
*Attorney, Agent, or Firm*—Walter G. Finch

[57] ABSTRACT

The invention concerns a method of making a decorative fan. Two types of paper are layered together, reinforced and are then pleated. The resulting pleats are gathered and are bound at one end by means of Mylar tape. A decorative disk is mounted at the gathered, tapered end to conceal the tape. The fan has a particular use as a decorative piece in front of a fireplace.

20 Claims, 5 Drawing Figures

FIREPLACE FAN

BACKGROUND OF THE INVENTION

The invention concerns a decorative fan and the method of making such a decorative fan. Throughout the winter to generate warmth and to create a certain ambiance, fireplaces are utilized. However during the summer months, the fireplaces sit idle, the open hearth being exposed. Efforts are frequently made to decorate the hearth with fireplace screens or flower arrangements.

Oriental fans are well known which are provided with numerous ribs joined at one end by a pin upon which each rib pivots. Silk, paper, or other materials are used to connect the ribs and provide the surface which generates a cool breeze when the fan is oscillated. In addition to serving as a means for cooling oneself, a fan may double as a social accoutrement or a decoration mounted upon a wall.

OBJECTS AND SUMMARY OF THE INVENTION

The primary object of the invention is to provide a sturdy, decorative fan which is easy to manufacture.

Another object of the invention is to provide a fan which is dimensioned, shaped, and designed to be aesthetically pleasing when placed in front of a fireplace.

The invention entails a decorative fan and a technique for production thereof, wherein a piece of foil is folded lengthwise and a piece of colored paper (wallpaper, for instance) is aligned thereon, two opposite edges of the foil and paper are glued with a reinforcing strip therebetween and the assembled sheet is then pleated. The resultant pleats are gathered at one end are taped together with Mylar tape. A brass plate is then affixed to the gathered end with a screw to decoratively hide the mylar tape. The fan may then be opened and positioned in front of a fireplace or in any desired location.

DETAILED DESCRIPTION OF THE INVENTION

Figure 1:
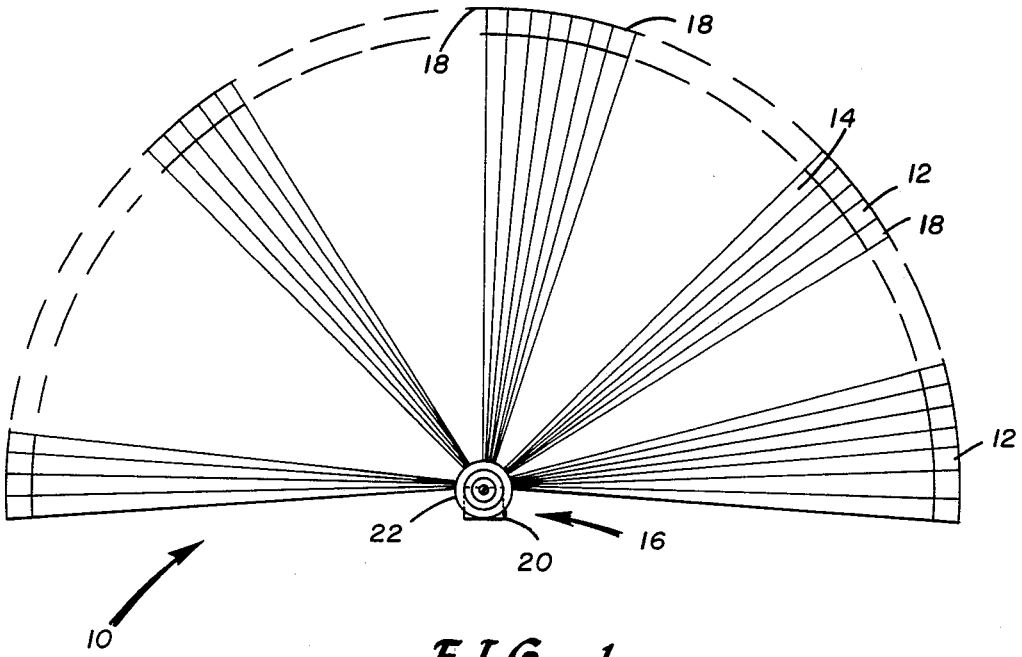
FIG. 1 shows an open fan, manufactured in accordance with the present invention.

FIG. 1 shows the fan 10 in its open position. The fan 10 comprises a layer of pleated foil paper 12 and a layer of pleated colored paper 14. The colored paper 14, in its preferred embodiment, is wallpaper, utilized because of the intricate patterns which are readily available and which are easily coordinated with a particular interior design. The colored paper is approximately 1 to 2 inches shorter than the foil paper so that when aligned the foil paper provides a decorate trim along the outside border of the fan 10. In addition, the heavy weight of the foil paper 12 provides vertical support to the fan 10 and maintains the fan 10 in its open position. At the base end 16 of the fan 10, the pleats of the foil paper 12 and the colored paper 14 are gathered such that the pleats at upper edge 18 are fanned open. The base end 16 of the gathered pleats are secured together by means of mylar tape which is wrapped around the base end 16. A decorative disk 22 is secured to the base end 16 by a screw 24. The details of the fan 10 construction are further diskussed with respect to FIGS. 2 through 5.

Figure 2:
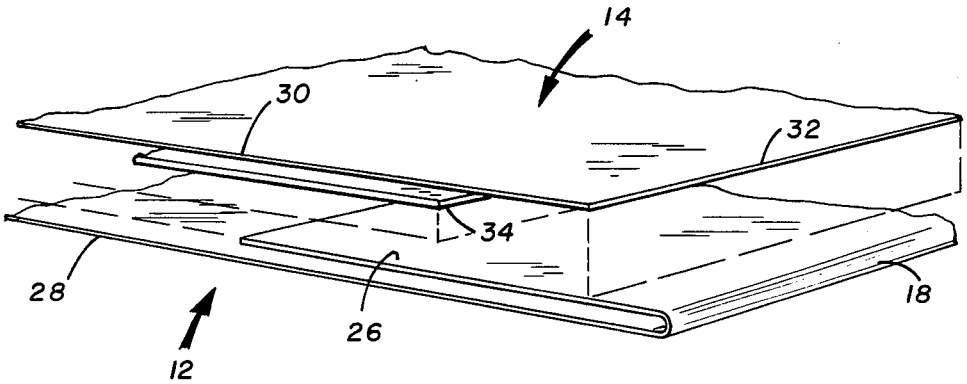
FIG. 2 shows the paper layers which are joined to form the body of the fan.

In FIG. 2 the steps involved in laminating the colored paper 14 to the foil paper 12 are evident. The foil paper 12 is typically provided with one gilded or shiny side and one dull side. According to the present invention, the foil paper 12 is placed with the gilded side down as viewed in FIG. 2. A lip 26 is then folded along one length of the foil paper 12, forming a continuous or rounded edge 18. The colored paper 14 is positioned to align with the foil paper 12 such that foil edge 28 and paper edge 30 align. A second paper edge 32 is spaced approximately one to two inches from the rounded edge 18 (to provide the gilt border at the top of the fan 10). The remaining edges (not visible) of the foil paper 12 and colored paper 14 are aligned in the manner of foil edge 28 and paper edge 30. The foil paper and colored paper 14 are secured to one another along their respective edges remote from rounded edge 18 in a temporary fashion. For instance, paper clips may be utilized. Positioned between the foil paper 12 and the colored paper 14 is a reinforcing strip 34 and which is located approximately one inch inside the foil edge 28 and paper edge 30. The reinforcing strip 34 is glued in place to provide lateral support to the pleated portions of the fan 10.

Figure 3:
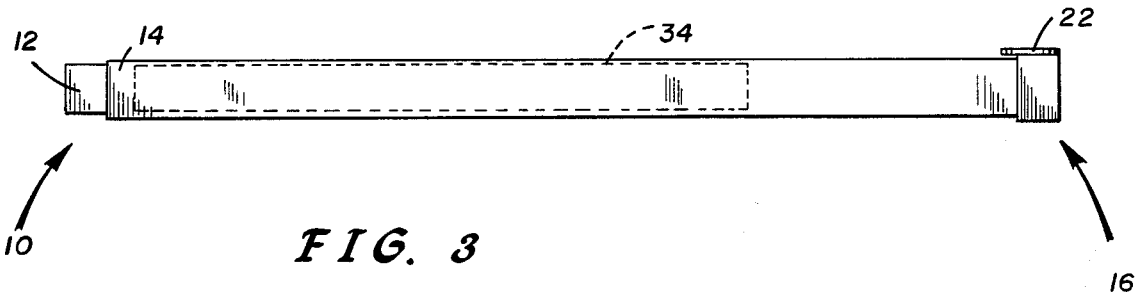
FIG. 3 is a side view of the fan.

FIG. 3 shows the relationship of the reinforcing strip 34 relative to the overall length of the fan 10 which is shown in a side view. The reinforcing strip 34 is offset relative to the colored paper 14 and is $\frac{2}{3}$ (approximately) the length of the fan 10 allowing flexibility of the fan 10 towards base end 16. At this point the temporary securing means (paper clips, e.g.) may be removed. Foil edge 28 and paper edge 30 are then folded downward forming a crease in the foil paper 12 and colored paper 14 about the reinforcing strip 34. The folding continues until the resulting flap is folded under the reinforcing strip 34 and which is then glued in place. The layered sheets (folded foil paper 12, colored paper 14) are then pleated using the reinforcing strip 34 as a guide for the width of each pleat.

Figure 4:
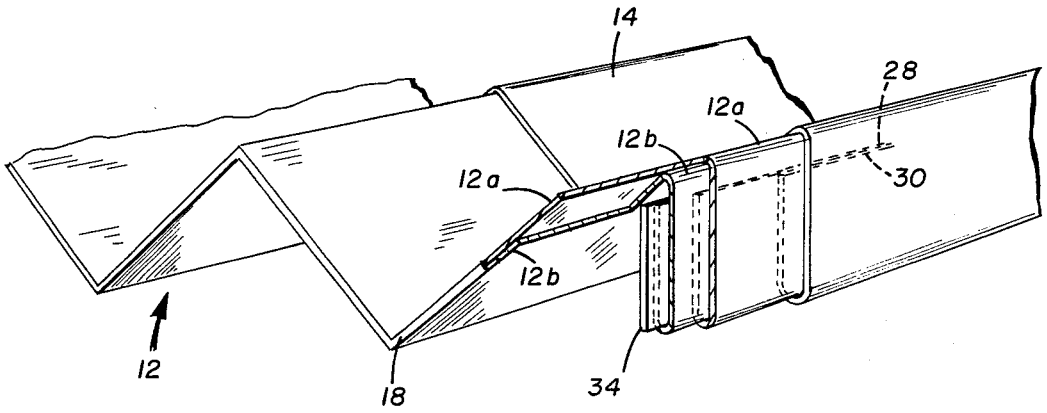
FIG. 4 is a detail of the upper end of the fan.
Figure 5:
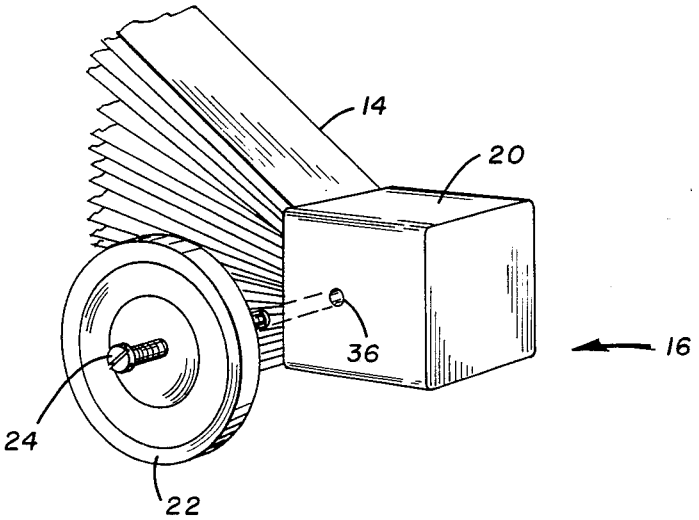
FIG. 5 shows a detail of the base end of the fan.

FIG. 4 shows the joined foil paper 12 and colored paper 14 after pleating. In this cutaway view the relationship of the reinforcing strip 34 to the numerous folds is apparent. The rounded edge 18 is cutaway to reveal the foil paper 12 folded upon itself at **12*a* and 12*b*. An extension of face 12*a* comprises the lip 26 which is the folded portion of foil paper 12. Face 12*b* extends the length of the fan 10 revealing a gilt facing along the back of fan 10. Once pleated, the layered sheets are gathered at the end opposite edge 18 (specifically toward base end 16) and are wrapped in mylar tape 20 as shown in FIG. 5. A decorative disk 22 of brass or other attractive composition is secured to the base end 16 by means of a threaded screw 24 which is turned into a previously bored hole 36. The fan 10 may now be opened to stand on its base end 16**, providing a decorative addition to any interior.

Other modifications are apparent to one skilled in the art which do not depart from the spirit of the invention. For instance, any type of decorative paper may be used in place of colored paper 14. The fan 10 may be produced in any variety of sizes. The gathered pleats may be secured with a brass head fastener, snap clip, or other device. The decorative disk 22 may be secured in place by glue or a brass tack. Accordingly, the described embodiments, are therefore considered to be only illustrated and not restrictive: the scope of the invention being defined by the appended claims.

What is claimed is:

1. A method of manufacturing a decorative object, the steps comprising:

layering first and second papers;

aligning the first and second papers relative to one another;

temporarily joining with a joining means the first and second papers to each other;

reinforcing the layered first and second papers along at least one common edge thereof;

pleating the layered first and second papers;

removing the joining means;

gathering and securing one end of the pleated first and second papers, and mounted a decorative member to the gathered and secured end of the first and second papers.

2. A method as in claim 1, the steps including: folding the first paper prior to layering the first and second papers.

3. A method as in claim 2, the steps including utilizing foil paper as the first paper.

4. A method as in claim 3, the steps including: utilizing colored paper as the second paper.

5. A method as in claim 4, wherein the aligning occurs along at least one common edge of the layered first and second papers.

6. A method as in claim 5, the steps including: joining the first and second papers along the aligned at least one edge.

7. A method as in claim 6, the steps including: joining the first and second papers with paper clips.

8. A method as in claim 7, the steps including: removing the paper clips.

9. A method as in claim 8, the steps including: utilizing at least one reinforcing strip to reinforce the layered first and second papers.

10. A method as in claim 9, the steps including: positioning the at least one reinforcing strip a distance substantially equal to the width of the reinforcing strip from an edge which is perpendicular to the at least one common edge of the layered first and second papers.

11. A method as in claim 10, the steps including: gluing the reinforcing strip in position.

12. A method as in claim 11, the steps including: folding a flap of the layered first and second papers about the reinforcing strip.

13. A method as in claim 12, the steps including: securing the one end of the pleated first and second papers by taping the one end.

14. A method as in claim 13, the steps including: boring a hole in the taped end of the first and second papers.

15. A method as in claim 14, the steps including: threading a screw through the decorative member and into the bored hole.

16. A decorative fan comprising:

a first pleated sheet;

a second pleated sheet parallel to the first pleated sheet;

two reinforcing strips glued along parallel first and second sheet ends to secure the first and second pleated sheets to one another;

a securing means securing the pleated sheets in a gathered end; and a disk mounted on the securing means substantially hiding the securing means from view.

17. A decorative fan as in claim 16, wherein the first pleated sheet is foil paper having a fold and the second pleated sheet is colored paper.

18. A decorative fan as in claim 17, wherein the reinforcing strips are cardboard strips positioned between the foil paper and colored paper a distance approximately equal to the strip thickness from the foil paper and colored paper ends.

19. A decorative fan as in claim 18, wherein the securing means is a length of Mylar tape wrapped about the gathered end.

20. A decorative fan as in claim 19, wherein the disk is mounted to the wrapped Mylar tape by means of a threaded screw.

* * * * *